US007212187B2

(12) United States Patent
Park et al.

(10) Patent No.: US 7,212,187 B2
(45) Date of Patent: May 1, 2007

(54) POWER CONTROL APPARATUS FOR A DISPLAY DEVICE AND METHOD OF CONTROLLING THE SAME

(75) Inventors: Sung-Chon Park, Gyeonggi-do (KR); Won-Kyu Kwak, Seongnam-si (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/992,663

(22) Filed: Nov. 22, 2004

(65) Prior Publication Data

US 2005/0116657 A1 Jun. 2, 2005

(30) Foreign Application Priority Data

Nov. 27, 2003 (KR) ..... 10-2003-0084784

(51) Int. Cl.
*G09G 3/36* (2006.01)

(52) U.S. Cl. ..... 345/100; 315/169.3

(58) Field of Classification Search .. 315/169.1–169.4; 345/76–87, 204, 58, 211, 98–100, 212, 60–68
See application file for complete search history.

(56) References Cited

U.S. PATENT DOCUMENTS 5,434,599 A * 7/1995 Hirai et al. ..... 345/100
5,696,522 A * 12/1997 Iwama ..... 345/60
6,633,135 B2 * 10/2003 Nara et al. ..... 315/169.3
6,677,925 B1 * 1/2004 Kawaguchi et al. ..... 345/98
6,873,117 B2 * 3/2005 Ishizuka ..... 315/169.1
6,961,053 B1 * 11/2005 Oguma ..... 345/204
2004/0130545 A1 * 7/2004 Ishizuka ..... 345/212

* cited by examiner

*Primary Examiner*—Wilson Lee
(74) *Attorney, Agent, or Firm*—H.C. Park & Associates, PLC

(57) ABSTRACT

A power control apparatus for a display device that measures a power supply voltage and a cathode voltage and adjusts electrical characteristics that deviate from predetermined conditions to satisfy the conditions, thus preventing damage of a panel due to an excessive current and deterioration. The power control apparatus comprises a first power supply line for transmitting a first level of power supply voltage to a pixel; a second power supply line for transmitting a second level of power supply voltage to the pixel; a DC power generator for generating the first level of power supply voltage and the second level of power supply voltage; and an output detecting unit connected to an output of the DC power generator and for measuring a driving current of a display device. The output detecting unit includes an output detecting circuit for detecting the driving current of the display device, and an output control unit for comparing the detection signal of the output detecting circuit and a designated level of power supply voltage to adjust the detected output power to the designated level.

7 Claims, 4 Drawing Sheets

POWER CONTROL APPARATUS FOR A DISPLAY DEVICE AND METHOD OF CONTROLLING THE SAME

This application claims the benefit of Korean Patent Application No. 2003-84784, filed Nov. 27, 2003, which is hereby fully set forth herein.

BACKGROUND OF THE INVENTION

1. Field of the Invention

The present invention relates to a display device and, more specifically, to a power control apparatus of a display device that measures an output current to a display panel and adjusts a power supply voltage and a cathode voltage to maintain the output current within designated conditions, thus preventing damage to the display panel due to excessive current and deterioration.

2. Discussion of the Related Art

Recently, portable electronic devices, such as portable handsets, notebooks, personal computers and personal data assistants, have become widely used. A display device, such as a liquid crystal display (LCD) or an electroluminescence (EL) display, is typically used as the display device in these portable electronic devices due to their low power consumption. The organic EL display and the LCD, which uses an organic EL device as a light emitting source, arrange, drive and control a plurality of display pixels by turning them on or off to display a desired image. Generally, the display device drives the pixels by supplying a power supply voltage and a cathode voltage to the panel. Typically, a low voltage power supply of 2.8~3.3V is used to drive the panel. A DC-DC converter raises the power supply voltage to +5V or reduces it to −6V and outputs that voltage to the display device.

FIG. 1 is a block diagram of a conventional display device.

A data driver 10 outputs a data signal to a pixel 51, a scan driver 20 outputs a selection signal to the pixel 51, a DC-DC converter 30 raises or reduces an input power supply voltage to output to the pixel 51, a control unit 40 controls each component, a panel 50 displays a certain image, and the pixel 51 displays a certain color on the panel 50.

As shown in FIG. 1, the panel 50 has a plurality of scan lines $S_1 \ldots S_m$ and a plurality of data lines $D_1 \ldots D_z$, arranged in rows and columns and connected to the scan driver 20 and the data driver 10, respectively. A plurality of pixels 51 are arranged at their intersections. Further, each pixel 51 is connected to a first level of power supply voltage line 52 and a second level of power supply voltage line 53, which are connected to the DC-DC converter 30. Further, the DC-DC converter 30 is connected to the control unit 40, and the control unit 40 is also connected to the scan driver 20 and the data driver 10.

For the conventional display device with the above configuration, when the control unit 40 transmits a driving control signal to the DC-DC converter 30, the DC-DC converter 30 raises or reduces the provided power supply voltage (not shown) to apply, for example, +5V to the first level of power supply voltage line 52 and −6V to the second level of power supply voltage line 53.

Further, the control unit 40 applies the driving control signal to the scan driver 20 and the data driver 10. The scan driver 20 outputs the selection signal to the pixel 51 through the appropriate scan line $S_1 \ldots S_m$, and the data driver 10 outputs a light emitting data signal to the pixel 51 through the appropriate data line $D_1 \ldots D_z$.

Therefore, each pixel 51 is turned on by the selection signal, and a certain color is emitted according to the data signal and the driving signal by the power supply voltage VDD and the cathode voltage VSS, so that the panel 50 displays the desired image.

However, the display device generally supplies the power supply voltage and the cathode voltage meeting conditions for driving each pixel, and when the panel's temperature goes beyond a certain range, the driving current transmitted to the panel may likewise go beyond a certain range, which may result in application of excessive current. The excessive current may cause excessive brightness, which causes panel deterioration and increases the current of a switching device provided to each pixel. Also, increased current may result in degraded efficiency of the panel.

SUMMARY OF THE INVENTION

The present invention provides a power control apparatus of a display device that measures an amount of the output current of a DC power generator and adjusts that output current if it is outside a designated range.

Additional features of the invention will be set forth in the description which follows, and in part will be apparent from the description, or may be learned by practice of the invention.

The present invention discloses a power control apparatus of a display device, comprising a first line for transmitting a first power supply voltage to a pixel, a second line for transmitting a second power supply voltage to the pixel, and a DC power generator that generates the first power supply voltage and the second power supply voltage. An output detecting unit is coupled to an output of the DC power generator, and it measures a driving current of the display device. The output detecting unit comprises an output detecting circuit for measuring the driving current and outputting a detection signal based on the measured driving current, and an output control unit for conducting a comparison of the detection signal and a designated amount of output current, and adjusting the first power supply voltage and the second power supply voltage of the DC power generator based on the comparison.

The present invention also discloses a method for controlling power of a display device, comprising outputting a first power supply voltage and a second power supply voltage to a pixel, measuring a driving current of the display device, and determining whether the measured driving current is within a designated range. At least one of the first power supply voltage and the second power supply voltage is adjusted when the measured driving current is not within the designated range.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. Like numbers refer to like elements throughout the specification.

Figure 1:
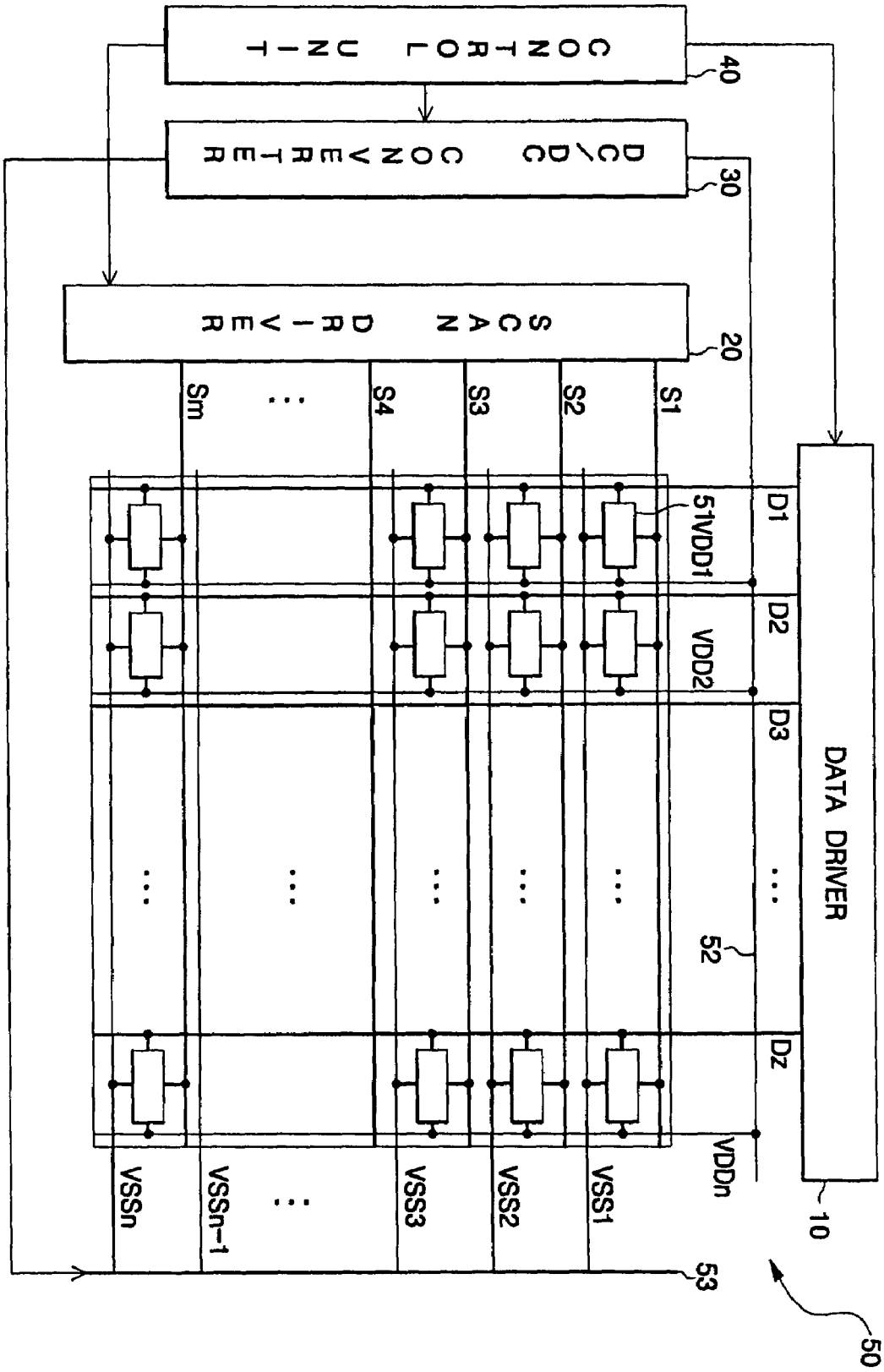
FIG. 1 (PRIOR ART)
FIG. 1 is block diagram showing a conventional display device.
Figure 2:
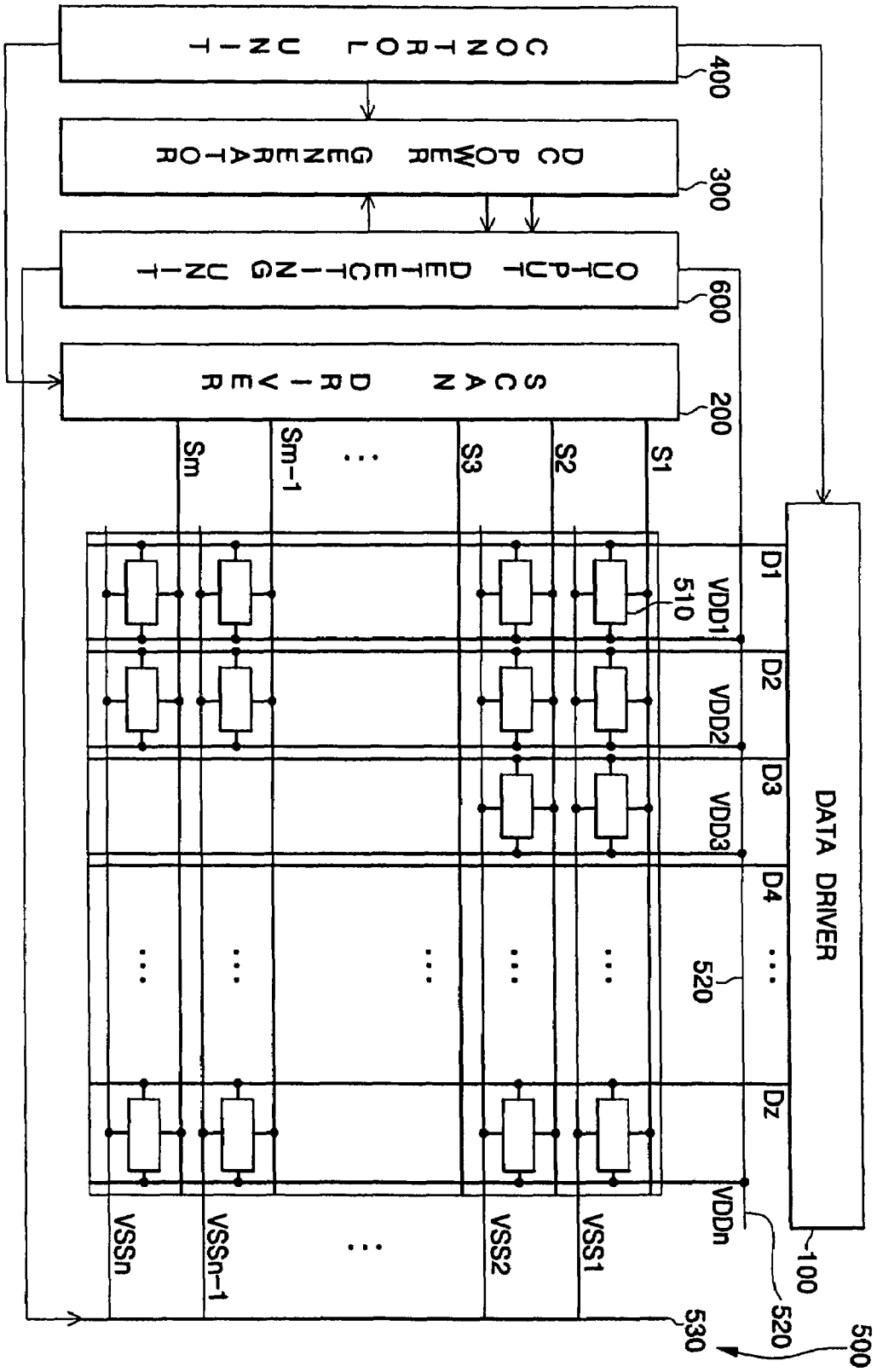
FIG. 2 is a block diagram of a power control apparatus of a display device according to an exemplary embodiment of the present invention.

FIG. 2 is block diagram showing a power control apparatus of a display device according to an exemplary embodiment of the present invention.

A data driver 100 outputs a data signal through a plurality of data lines $D_1 \ldots D_z$, a scan driver 200 outputs a selection signal through a plurality of scan lines $S_1 \ldots S_m$, a DC power generator 300 outputs a first level of power supply voltage VDD and a second level of power supply voltage VSS, and a control unit 400 controls each component. A panel 500 includes the data lines $D_1 \ldots D_z$ and the scan lines $S_1 \ldots S_m$ arranged in column and row format, and a plurality of pixels 510 are formed at intersections thereof. An output detecting unit 600 is coupled to an output of the DC power generator 300 to convert the output and to detect and control a driving current of the panel 500.

Referring to FIG. 2, the control unit 400 is coupled to the scan driver 200, the data driver 100, and the DC power generator 300, which is connected to the output detecting unit 600. The output detecting unit 600 is coupled to the first level of power supply voltage line 520 and the second level of power supply voltage line 530, and it is arranged close to the panel 500. The first level of power supply voltage line 520 transmits the first level of power supply voltage VDD, and the second level of power supply voltage line 530 transmits the second level of power supply voltage VSS, to the pixels 510.

The control unit 400 transmits the driving control signal to the DC power generator 300, the scan driver 200, and the data driver 100. The DC power generator 300 then outputs the first level of power supply voltage VDD of +5V and the second power supply voltage VSS of −6V. Further, the scan driver 200 and the data driver 100 output the selection signal and the data signal to each pixel 510 through the scan lines $S_1 \ldots S_m$ and data lines $D_1 \ldots D_z$ according to the driving control signal. Therefore, the selection signal turns on the pixels 510, and the data signal and the driving current by the first level of power supply voltage VDD and the second level of power supply voltage VSS are applied to each pixel 510, so that the whole panel 500 displays an image by emitting light.

The output detecting unit 600 detects the driving current of the panel 500 and compares the detected driving current with a designated range. As a result, when the output detecting unit 600 detects a driving current outside the designated range, it may turn off the DC power generator 300 or control the output signal of the DC power generator 300 so that the driving current falls within the designated range.

Figure 3:
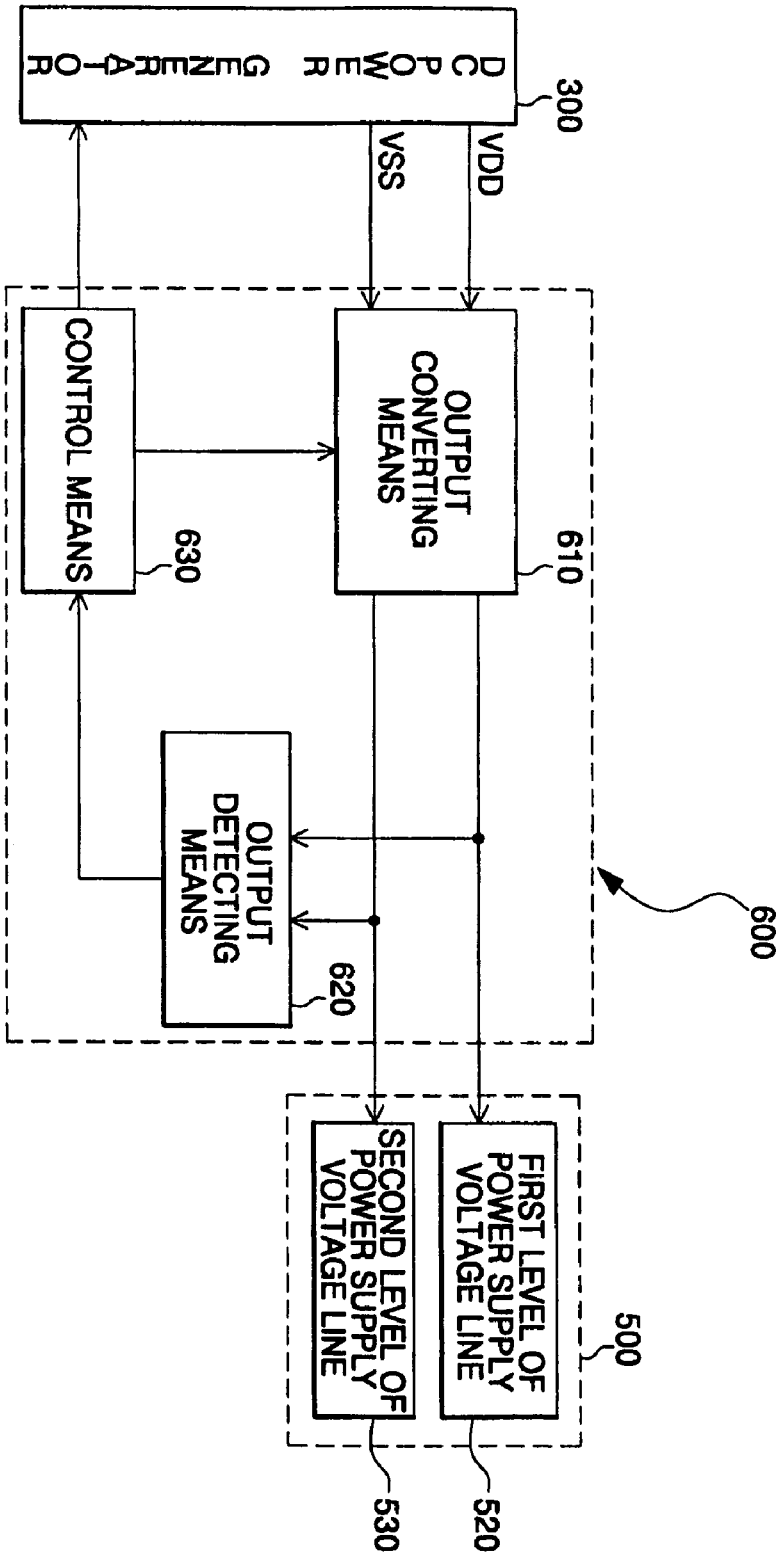
FIG. 3 is a detailed block diagram of a power control apparatus of a display device according to an exemplary embodiment of the present invention.

FIG. 3 is a detailed block diagram illustrating a power control apparatus of a display device of an exemplary embodiment of the present invention.

Referring to FIG. 3, the output detecting unit 600 may include an output converting means 610, an output detecting means 620, and a control means 630. The output converting means 610 is coupled to the output line of the DC power generator 300, and it adjusts the output voltage of the DC power generator 300. The output detecting means 620, which is coupled between the output converting means 610 and the first level of power supply voltage line 520 and the second level of power supply voltage line 530, detects the driving current of the panel 500. The control means 630 is coupled to the output detecting means 620, the output converting means 610 and the DC power generator 300, and it controls the output converting means 610 and the DC power generator 300.

Here, the output voltage of the DC power generator 300 is applied to the panel 500, which functions as a load. As a result, a driving current is generated in the panel 500 and transmitted to each pixel 510. Therefore, it is preferable to couple the output detecting means 620 to an output of the DC power generator 300 so that the driving current may be measured close to the panel 500.

An operation of the above configuration will be described with reference to the flow chart of FIG. 4.

Figure 4:
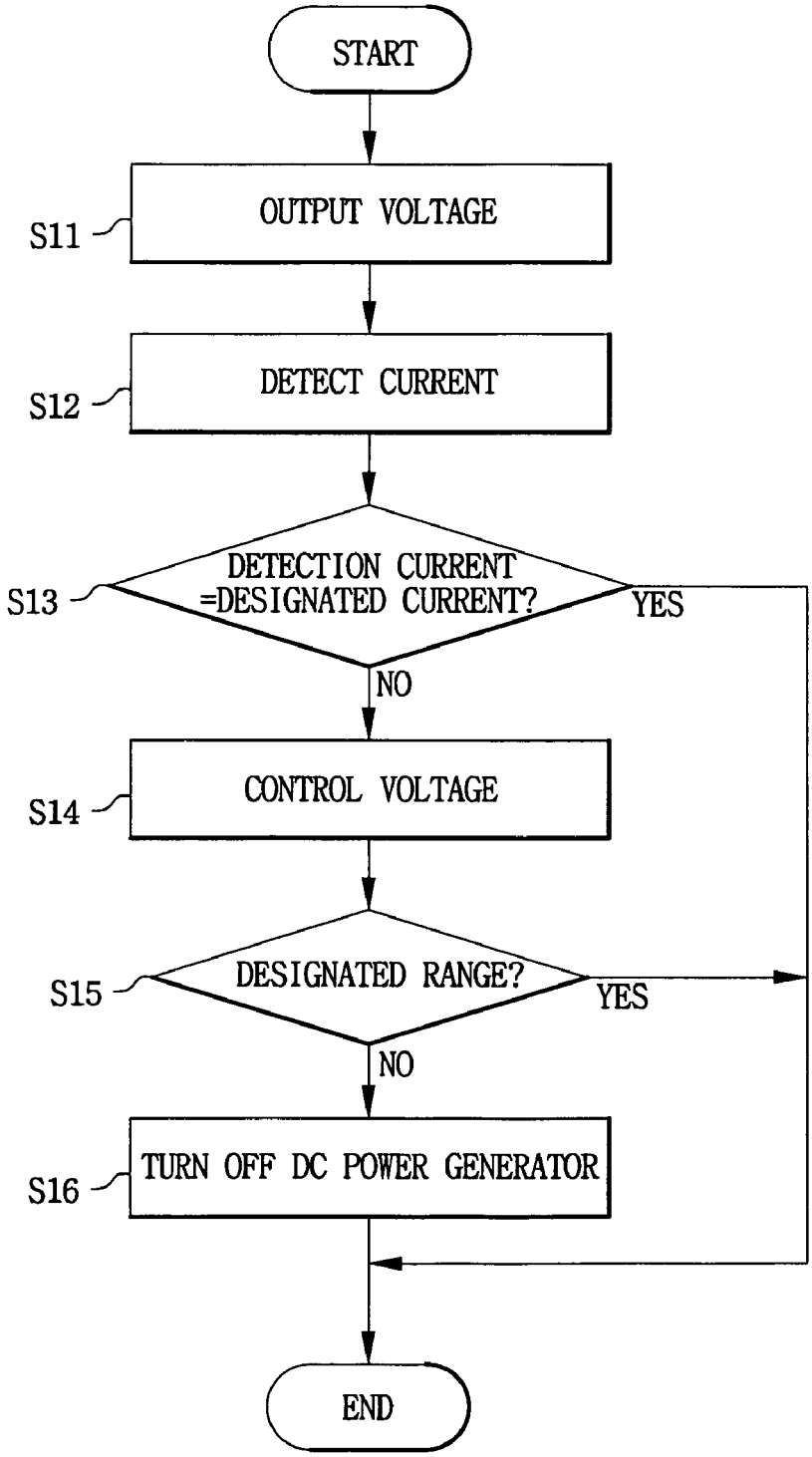
FIG. 4 is a flow chart showing a method of controlling a display power supply according to an exemplary embodiment of the present invention.

FIG. 4 is a flow chart showing a method of controlling power of a display device according to an exemplary embodiment of the present invention.

As described above, when the control unit 400 applies the driving control signal, the DC power generator 300 raises or reduces a power supply voltage of approximately 2 to 3V or outputs a power supply voltage of +5V and a cathode voltage of −6V. The output voltage from the DC power generator 300 is coupled to the first level of power supply voltage line 520 and the second level of power supply voltage line 530. (S11).

The output detecting means 620 detects the driving current of the panel 500 applied to the first level of power supply voltage line 520 and the second level of power supply voltage line 530, and applies the detection signal to the control means 630 (S12). The output detecting means 620 may be a current sensor.

Therefore, the control means 630 compares the applied detection signal and the designated amount of output current. As a result, when the detection signal indicates that the driving current is not within the designated range of output current, the control means 630 outputs the voltage converting control signal to the output converting means 610 (S13).

The output converting means 610 may then raise or reduce at least one of the first level of power supply voltage VDD and the second level of power supply voltage VSS according to the applied voltage converting control signal (S14). The output converting means 610 may be a potentiometer that automatically adjusts the first level of power supply voltage VDD and the second level of power supply voltage VSS according to a relation between the designated output current and the voltage converting control signal.

Further, when the output converting means 610 completes the voltage conversion, the output detecting means 620 detects the converted driving current of the panel 500 so that it may apply a detection signal to the control unit 630 based on the converted driving current. The control means 630 compares this applied detection signal and the designated range to determine a result according to the voltage conversion of the output converting means 610. In other words, after the output converting means 610 completes the voltage conversion, when the current value detected by the output detecting means 620 is within the designated range, the given voltage is applied to the first level of power supply voltage line 520 and the second level of power supply voltage line 530 (S15).

However, if the output detecting means 620 detects an excessive current after the output converting means 610 has completed the voltage conversion, the control unit 630 determines that the output current goes beyond the adjusting range of the output converting means 610 and turns off the DC power generator 300 (S16).

Therefore, excessive driving current may be prevented, which may prevent degradation of characteristics and efficiency of the DC power generator 300.

As illustrated above, the power control apparatus according to exemplary embodiments of the present invention detects an excessive current of a panel and controls the output voltage of the DC power generator within a designated range, or turns it off, thereby preventing the degradation of efficiency and characteristics of the DC power generator. As the power supply is stably provided to the panel by the driving control of the DC power generator as described above, a switching transistor and a driving transistor provided for each pixel may be stably driven.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A power control apparatus of a display device, comprising:

a first line for transmitting a first power supply voltage to a pixel;

a second line for transmitting a second power supply voltage to the pixel;

a DC power generator for generating the first power supply voltage and the second power supply voltage; and an output detecting unit coupled to an output of the DC power generator and for measuring a driving current of the display device, wherein the output detecting unit comprises, an output detecting circuit for measuring the driving current and outputting a detection signal based on the measured driving current; and an output control unit for conducting a comparison of the detection signal and a designated range of output current and adjusting the driving current based on the comparison.

2. The power control apparatus of claim 1, wherein the output detecting circuit measures the driving current with a current sensor.

3. The power control apparatus of claim 1, wherein the output control unit comprises:

a control circuit for controlling the DC power generator according to the comparison; and an output converting circuit for controlling an output signal of the DC power generator according to the comparison.

4. The power control apparatus of claim 3, wherein the output converting circuit adjusts at least one of the first power supply voltage and the second power supply voltage according to a voltage converting control signal from the control circuit.

5. The power control apparatus of claim 4, wherein the output converting circuit comprises a potentiometer.

6. The power control apparatus of claim 1, wherein the display device is a flat panel display device.

7. The power control apparatus of claim 6, wherein the display device is an organic electroluminescence display device or a liquid crystal display device using an organic electroluminescence device as a light emitting source.

* * * * *